US008297204B1

(12) United States Patent
Giannoccora

(10) Patent No.: US 8,297,204 B1
(45) Date of Patent: Oct. 30, 2012

(54) ADJUSTABLE TABLE SYSTEM

(76) Inventor: Richard Giannoccora, Glenshaw, PA (US)

( * ) Notice: Subject to any disclaimer, the term of this patent is extended or adjusted under 35 U.S.C. 154(b) by 69 days.

(21) Appl. No.: 12/958,741

(22) Filed: Dec. 2, 2010

(51) Int. Cl.
*A47B 5/00* (2006.01)

(52) U.S. Cl. ..... 108/48; 108/42; 108/143

(58) Field of Classification Search ..... 108/42, 108/48, 47, 150, 143, 137, 140, 102, 90; 248/188, 188.1
See application file for complete search history.

(56) References Cited

U.S. PATENT DOCUMENTS

| | | | | | |
|---|---|---|---|---|---|
| 2,509,332 | A | * | 5/1950 | Budd | 108/142 |
| 3,105,448 | A | | 10/1963 | Patrie | |
| 3,257,933 | A | * | 6/1966 | Brian | 108/48 |
| 3,736,884 | A | * | 6/1973 | Kohner | 108/48 |
| 3,866,548 | A | * | 2/1975 | Skonieczny | 108/48 |
| 3,879,084 | A | | 4/1975 | Jones | |
| 4,019,443 | A | * | 4/1977 | Jones | 108/137 |
| 4,130,070 | A | * | 12/1978 | Herrin | 108/143 |
| 4,180,298 | A | * | 12/1979 | Borgerson, Jr. | 312/242 |
| 4,803,930 | A | * | 2/1989 | Crocoli | 108/48 |
| 5,409,296 | A | | 4/1995 | Barile | |
| 5,452,936 | A | | 9/1995 | Koehring | |
| 5,544,592 | A | * | 8/1996 | Leezer | 108/48 |
| 5,549,055 | A | * | 8/1996 | Kusch | 108/159.11 |
| 5,727,478 | A | | 3/1998 | Rahn et al. | |
| D396,971 | S | | 8/1998 | Svensson | |
| 5,823,616 | A | | 10/1998 | Scott | |
| 5,947,416 | A | * | 9/1999 | Kraft | 108/42 |
| 2006/0162626 | A1 | * | 7/2006 | Brauning et al. | 108/143 |
| 2009/0249982 | A1 | * | 10/2009 | Palethorpe | 108/48 |

* cited by examiner

*Primary Examiner* — Jose V Chen

(57) ABSTRACT

An adjustable table system featuring a table, a brace slidably attached to the bottom of the table, and a pedestal extending downwardly from the brace. A wall plate for attaching to a wall is slidably attached to a side edge of the table such that the table can slide in a with respect to the wall. A portion of the wall plate with protrusions extends downwardly below the bottom of the table. A shaft mounted to the table via a mount can move between a first position wherein the first end of the shaft is inserted into a protrusion and a second position wherein the first end of the shaft is out of the protrusion. The spring-loaded mount biases the shaft in the first position. When the first end of the shaft is out of the protrusions the table can slide side to side with respect to the wall.

1 Claim, 3 Drawing Sheets

ADJUSTABLE TABLE SYSTEM

FIELD OF THE INVENTION

The present invention is directed to a table system for restaurants, more particularly to a table system that is adjustable to allow persons of large size to sit in booths comfortably.

BACKGROUND OF THE INVENTION

Many larger individuals must sit at standard tables in restaurants because the booths are too small for them. The present invention features a table system that is adjustable to allow persons of large size to sit in booths comfortably. The system of the present invention enables larger customers to sit comfortably in booths, which can be ideal when larger individuals desire privacy for a meeting or a date. The design of the table system of the present invention makes it possible to sit in a booth without being constricted or uncomfortable.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features an adjustable table system. In some embodiments, the system comprises a table base having a top surface and a bottom surface; a pedestal having a brace disposed on a top end, the brace is slidably attached to the bottom surface of the table base via a first slide system such that the table base can slide in a first direction and a second direction with respect to the pedestal, the pedestal extends downwardly from the bottom surface of the table base; a wall plate for fixedly attaching to a wall, the wall plate is slidably attached to a first side edge of the table base via a second slide system such that the table base can slide in a first direction and a second direction with respect to the wall, a portion of the wall plate extends downwardly a distance below the bottom surface of the table base and a plurality of protrusions is disposed in the portion of the wall plate that extends the distance below the bottom surface of the table base, the protrusions extend outwardly; a shaft having a first end and a second end, the second end is positioned on the bottom surface of the table base at or near a second side edge and the first end is positioned at the wall plate and further into a protrusion, the shaft traverses the brace, the shaft is attached to the bottom surface of the table base via a mount, the shaft can move through the mount between at least a first position wherein the first end of the shaft is inserted into a protrusion and a second position wherein the shaft is pulled outwardly in such that the first end of the shaft is out of the protrusions, when the first end of the shaft is out of the protrusions the table base can slide side to side with respect to the wall; a stopper fixedly attached to the shaft closer to the first end of the shaft than the mount; a spring extending from the stopper to the mount, the spring biases the shaft in the first position; and a handle disposed on the second end of the shaft allowing a user to grip the shaft and pull the shaft to the second position.

In some embodiments, the first slide system comprises a first T guide extending upwardly from a top surface of the brace and a first T slot disposed in the bottom surface of the table base, wherein the first T guide slidably engages the first T slot. In some embodiments, the second slide system comprises a second T guide disposed on an inner surface of the wall plate and a second T slot disposed in the first side edge of the table base, wherein the second T guide slidably engages the second T slot.

DESCRIPTION OF PREFERRED EMBODIMENTS

Figure 1:
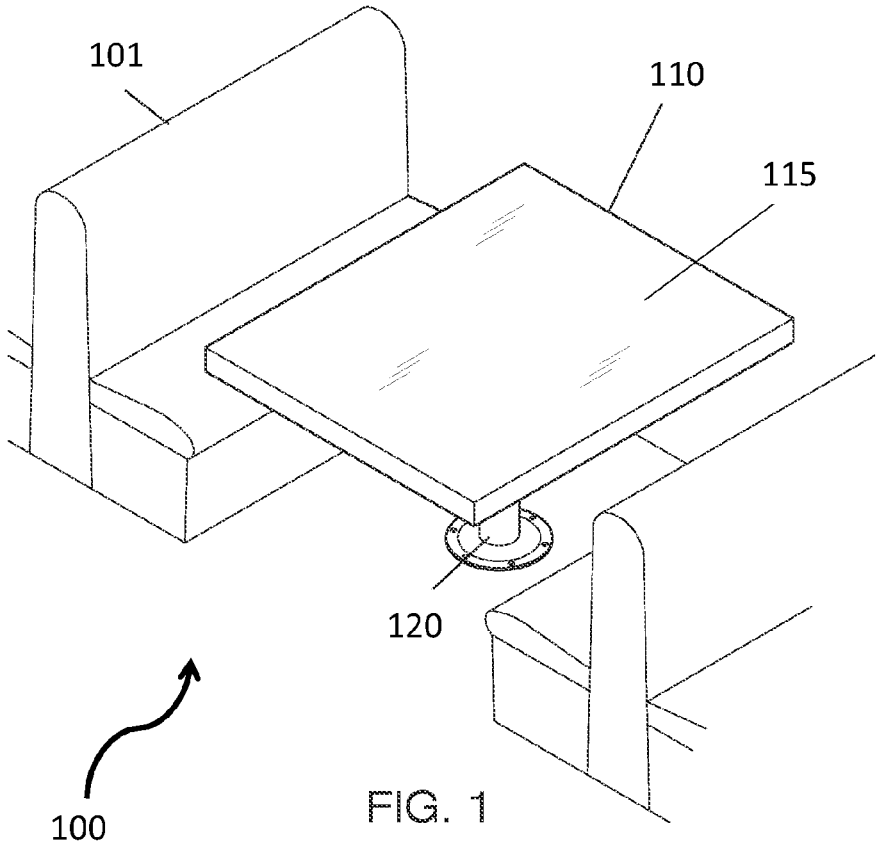
FIG. 1 is a perspective in-use view of the table system of the present invention.
Figure 2:
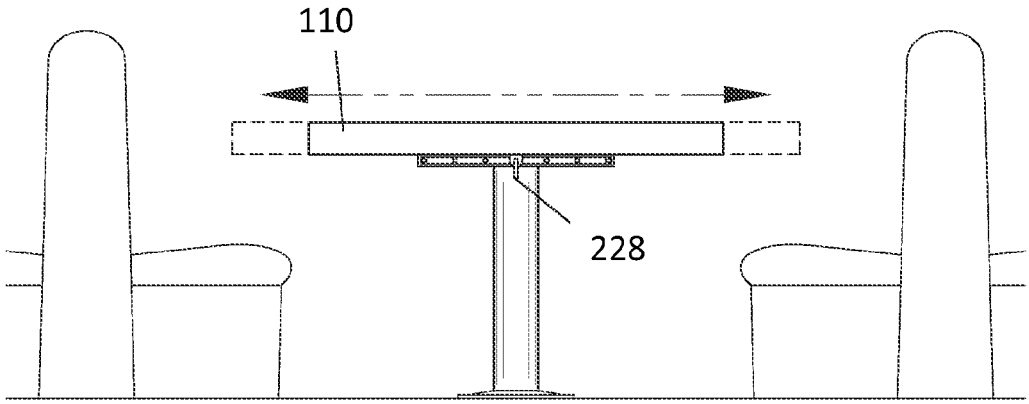
FIG. 2 is a side in-use view of the table system of the present invention.

Referring now to FIGS. 1-6, the present invention features an adjustable table system that allows persons of large size to sit in booths comfortably. The table system 100 comprises a table base 110 that functions as a table for eating. The table base 110 has a top surface 115 and a bottom surface 116. The table base 110 may be generally hollow, forming an inner cavity. In some embodiments, a pedestal 120 extends downwardly from the bottom surface 116 of the table base 110. Such table bases and pedestals are well known to one of ordinary skill in the art and are commonly seen in restaurants. The pedestal 120 can be secured to a ground surface (e.g., via bolts, etc.), for example between two benches 101 to form a booth.

Figure 6:
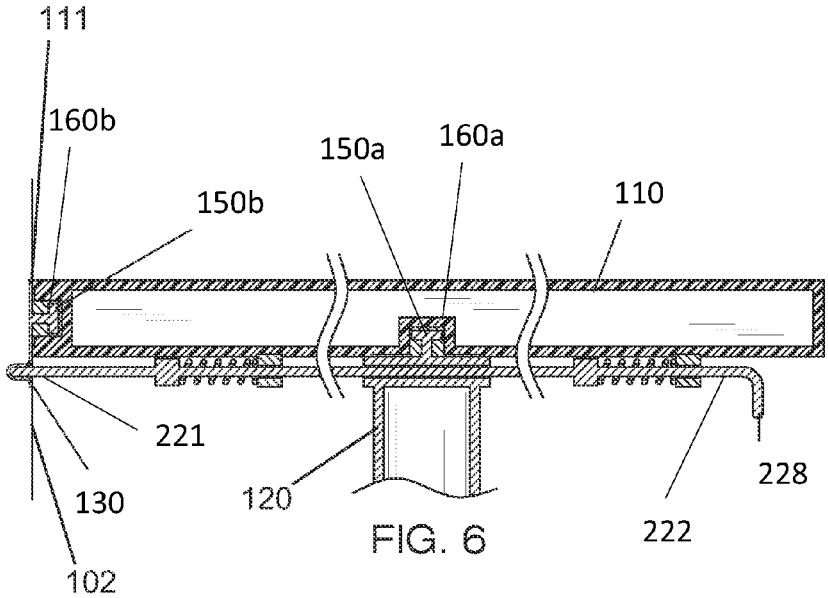
FIG. 6 is a side cross sectional view of the table system of the present invention.

The pedestal 120 is attached to the bottom surface 116 of the table base 110 via a brace 210, e.g., the pedestal 120 is fixedly attached to the brace 210. The brace 210 is slidably attached to the bottom surface 116 of the table base 110. This allows the table base 110 to slide relative to the pedestal 120. As shown in FIG. 6, a first T guide 150*a* extends upwardly from the top surface of the brace 210. The first T guide 150*a* is slidably engaged in a first T slot 160*a* disposed in the bottom surface of the table base 110. When the first T guide 150*a* slides in the first T slot 160*a*, the table base 110 moves in a first direction or a second direction with respect to the pedestal 120.

Figure 3:
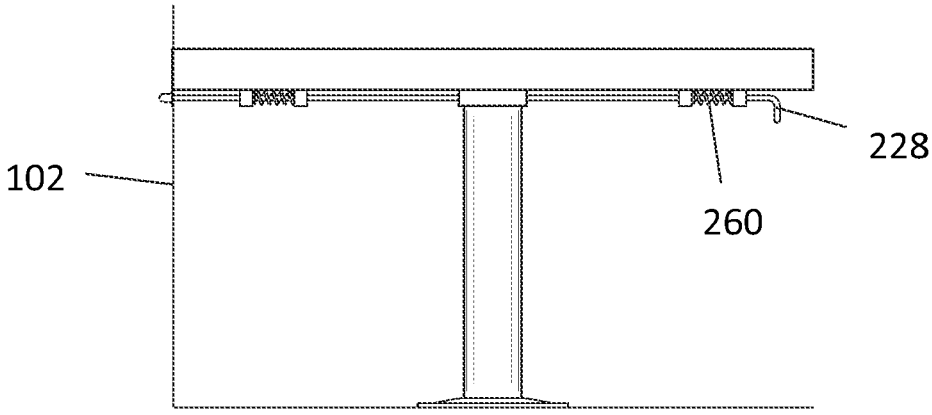
FIG. 3 is a side view of the table system of the present invention.
Figure 4:
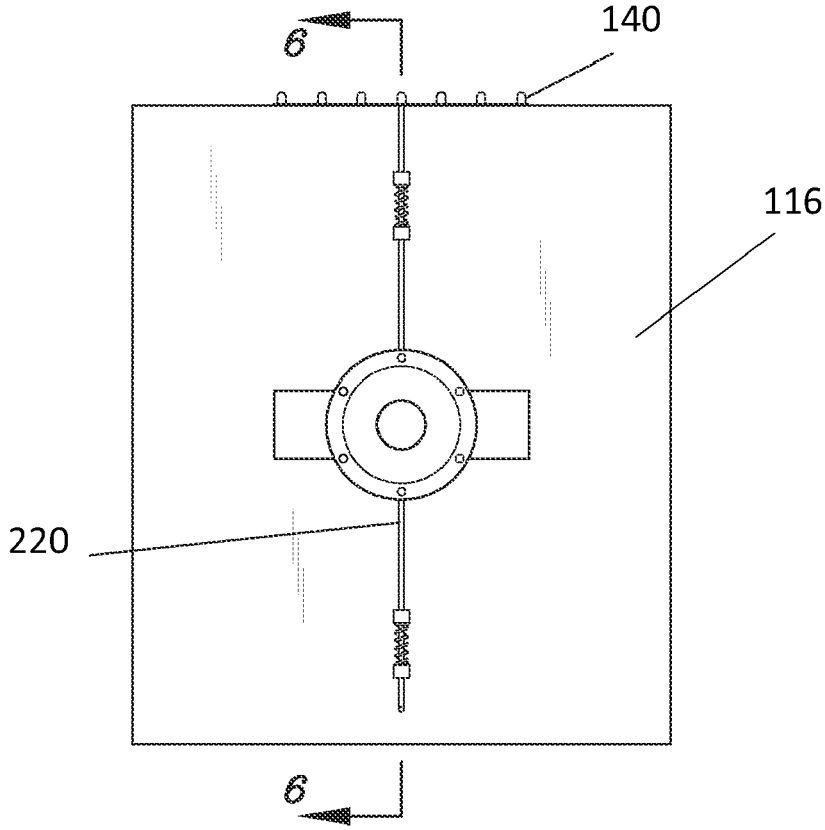
FIG. 4 is a bottom view of the table system of the present invention.
Figure 5:
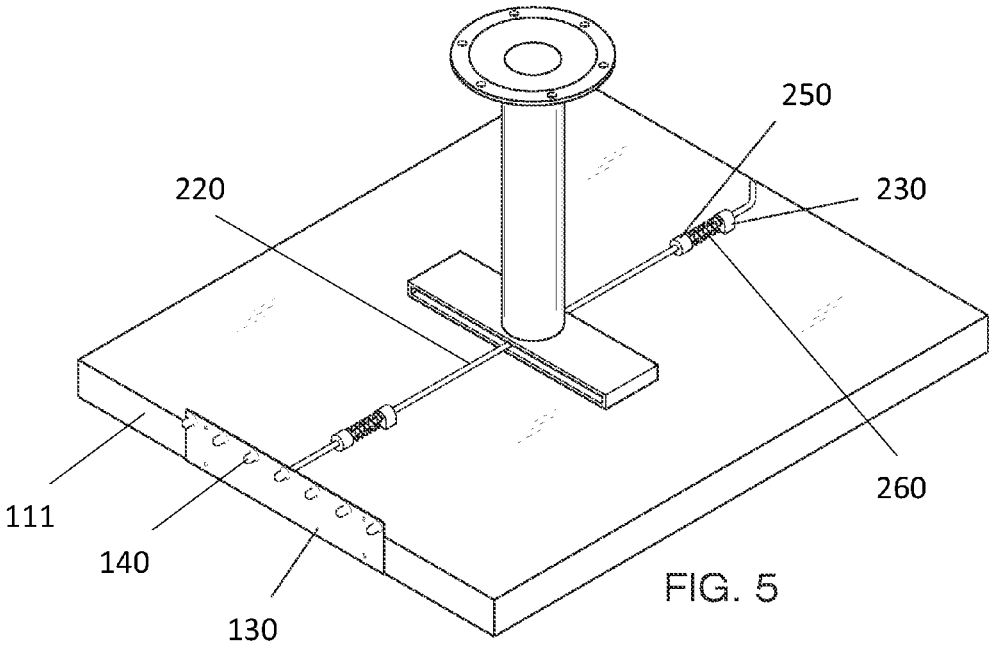
FIG. 5 is a perspective bottom view of the table system of the present invention.

In some embodiments, the table base 110 can be secured to a wall 102, for example a wall next to the benches 101, via a wall plate 130 (e.g., see FIG. 3). The wall plate 130 is disposed (e.g., slidably attached) on a first side edge 111 of the table base 110 and extends downwardly a distance below the bottom surface 116 of the table base 110. Disposed in the wall plate 130 (in the portion below the bottom surface 116 of the table base 110) is a plurality of protrusions 140. The protrusions 140 extend outwardly in the direction away from the table base 110.

The wall plate 130 is fixedly attached to the wall 102. The wall plate 130 is slidably attached to the first side edge 111 of the table base 110. For example, a second T guide 150*b* is disposed on the inner surface of the wall plate 130 (the inner surface faces the first side edge 111 of the table base 110), and the second T guide 150*b* slides within a second T slot 160*b* disposed in the first side edge 111 of the table base 110. This allows the table base 110 to slide in a first direction and a second direction with respect to the wall 102 (and pedestal 120).

The table system 100 further comprises a shaft 220 having a first end 221 and a second end 222. The second end 222 is positioned on the bottom surface 116 of the table base 110 at or near the second side edge 112 (e.g., the second side edge 112 being opposite the first side edge 111), and the first end 221 is positioned at the wall plate 130 and further into a protrusion 140. The shaft 220 traverses the brace 210 (e.g., see FIG. 6). The shaft 220 is attached to the bottom surface 116 of the table base 110 via a mount 230 (or multiple mounts 230). The shaft 220 can move inwardly (in the direction of the first side edge 111 of the table base 110) and outwardly (in the direction of the second side edge 112 of the table base 110) through the mount 230 (and brace 210). The shaft 220 can move between at least a first position wherein the first end 221 of the shaft 220 is inserted into one of the protrusions 140 and a second position wherein the shaft 220 is pulled outwardly in the second direction such that the first end 221 of the shaft 220 is out of the protrusions 140. When the first end 221 of the shaft 220 is out of the protrusions 140, the table base 110 can slide side to side with respect to the wall 102.

A stopper 250 is fixedly attached to the shaft 220 a distance from the mount 230. For example, the stopper 250 is positioned closer to the first end 221 of the shaft 220 than the mount 230. A spring 260 extends from the stopper 250 to the mount 230. The spring 260 biases the shaft 220 in the first position (e.g., the spring 260 pushes against the mount 230, pushing the shaft 220 in the first direction. In some embodiments, a handle 228 is disposed on the second end 222 of the shaft 220, allowing a user to grip the shaft 220 and pull the shaft 220 in the second direction to the second position.

The disclosures of the following U.S. patents are incorporated in their entirety by reference herein: U.S. Pat. No. 3,879,084; U.S. Pat. No. 5,727,478; U.S. Pat. No. 3,105,448; U.S. Pat. No. 5,452,936; U.S. Pat. No. 5,823,616; U.S. Pat. No. 5,409,296; U.S. Design Pat. No. D396,971.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An adjustable table system comprising:

(a) a table base 110 having a top surface 115 and a bottom surface 116;

(b) a pedestal 120 having a brace 210 disposed on a top end, the brace 210 is slidably attached to the bottom surface 116 of the table base 110, wherein a first T guide 150*a* extends upwardly from a top surface of the brace 210 and a first T slot 160*a* is disposed in the bottom surface 116 of the table base 110, wherein the first T guide 150*a* slidably engages the first T slot 160*a*, such that the table base 110 can slide in a first direction and a second direction with respect to the pedestal 120, the pedestal 120 extends downwardly from the bottom surface 116 of the table base 110;

(c) a wall plate 130 for fixedly attaching to a wall 102, the wall plate 130 is slidably attached to a first side edge 111 of the table base 110, wherein, a second T guide 150*b* is disposed on the inner surface of the wall plate 130, wherein an inner surface of the wall plate 130 faces the first side edge 111 of the table base 110, wherein the second T guide 150*b* slides within a second T slot 160*b* disposed in the first side edge 111 of the table base 110, such that the table base 110 can slide in a first direction and a second direction with respect to the wall 102 and pedestal 120, wherein a portion of the wall plate 130 extends downwardly a distance below the bottom surface 116 of the table base 110 and a plurality of protrusions 140 is disposed in the portion of the wall plate 130 that extends the distance below the bottom surface 116 of the table base 110, the protrusions 140 extend outwardly;

(d) a shaft 220 having a first end 221 and a second end 222, the second end 222 is positioned on the bottom surface 116 of the table base 110 at or near a second side edge 112 and the first end 221 is positioned at the wall plate 130 and further into a protrusion 140, the shaft 220 traverses the brace 210, the shaft 220 is attached to the bottom surface 116 of the table base 110 via a mount 230, the shaft 220 can move through the mount 230 between at least a first position wherein the first end 221 of the shaft 220 is inserted into a protrusion 140 and a second position wherein the shaft 220 is pulled outwardly in such that the first end 221 of the shaft 220 is out of the protrusions 140, when the first end 221 of the shaft 220 is out of the protrusions 140 the table base 110 can slide side to side with respect to the wall 102;

(e) a stopper 250 fixedly attached to the shaft 220 closer to the first end 221 of the shaft 220 than the mount 230;

(f) a spring 260 extending from the stopper 250 to the mount 230, the spring 260 biases the shaft 220 in the first position; and (g) a handle 228 disposed on the second end 222 of the shaft 220 allowing a user to grip the shaft 220 and pull the shaft 220 to the second position.

* * * * *